US011174714B2

(12) United States Patent
Wickramathilaka

(10) Patent No.: US 11,174,714 B2
(45) Date of Patent: Nov. 16, 2021

(54) POLYOL FOR IMPROVING SWEEP EFFICIENCY IN OIL RESERVOIRS

(71) Applicant: CONOCOPHILLIPS COMPANY, Houston, TX (US)

(72) Inventor: Siluni L. Wickramathilaka, Katy, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 166 days.

(21) Appl. No.: 14/273,071

(22) Filed: May 8, 2014

(65) Prior Publication Data

US 2014/0332209 A1 Nov. 13, 2014

Related U.S. Application Data

(60) Provisional application No. 61/820,955, filed on May 8, 2013.

(51) Int. Cl.
*E21B 43/24* (2006.01)
*E21B 43/16* (2006.01)

(52) U.S. Cl.
CPC ..... *E21B 43/24* (2013.01); *E21B 43/16* (2013.01); *E21B 43/2408* (2013.01)

(58) Field of Classification Search
CPC ..... E21B 43/24; C09K 8/584
See application file for complete search history.

(56) References Cited

U.S. PATENT DOCUMENTS

| | | | | |
|---|---|---|---|---|
| 2,431,500 | A | 11/1945 | Penick | |
| 2,771,138 | A | 11/1956 | Beeson | |
| 2,775,557 | A | 12/1956 | Morgan | |
| 2,842,492 | A | 7/1958 | Von Engelhardt | |
| 3,002,960 | A | 10/1961 | Kolodny | |
| 3,039,529 | A | 6/1962 | McKennon | |
| 3,282,337 | A | 11/1966 | Pye | |
| 3,298,436 | A * | 1/1967 | McCardell | C09K 8/584 166/270.1 |
| 3,468,377 | A | 9/1969 | Dunlap | |
| 3,553,130 | A | 1/1971 | Stratton | |
| 3,565,175 | A * | 2/1971 | Wilson | C09K 8/588 166/269 |
| 3,581,824 | A | 6/1971 | Hurd | |
| 3,691,072 | A * | 9/1972 | Le Roy | C09K 8/584 166/270.2 |
| 3,704,990 | A * | 12/1972 | Sarem | C09K 8/588 166/400 |

(Continued)

*Primary Examiner* — Angela M DiTrani Leff
*Assistant Examiner* — Avi T Skaist
(74) *Attorney, Agent, or Firm* — Boulware & Valoir

(57) ABSTRACT

The proposed method is an improved chemical flooding of an oil reservoir, especially one containing heavy oil or bitumen, that is cheaper than traditional chemical flooding techniques. This is obtained by viscosifying the displacing phase with a polyol, such as glycerol and/or its derivatives. Glycerol and its derivatives are an excellent additive because they are cheaper than the more commonly used chemicals, work only as a viscosifying agent, do not alter the reservoir properties, and have a wide range of viscosity facilitating the displacement of a wider range of heavy oils. This improved chemical flooding can be used with any other enhanced oil recovery technique, including thermal means, solvent assisted and polymer floodings.

10 Claims, 3 Drawing Sheets

(56) References Cited

U.S. PATENT DOCUMENTS

| | | | | | |
|---|---|---|---|---|---|
| 3,757,863 | A * | 9/1973 | Clampitt | C09K 8/588 | 166/270 |
| 3,841,401 | A | 10/1974 | Restaino | | |
| 3,862,044 | A * | 1/1975 | Christopher | C09K 8/58 | 507/203 |
| 4,140,183 | A | 2/1979 | Holm | | |
| 4,344,485 | A * | 8/1982 | Butler | E21B 43/2405 | 166/265 |
| 4,458,759 | A * | 7/1984 | Isaacs | E21B 43/24 | 166/272.3 |
| 4,470,899 | A | 9/1984 | Miller | | |
| 4,612,991 | A * | 9/1986 | Shaw | B01F 17/005 | 166/270.1 |
| 4,807,704 | A | 2/1989 | Hsu | | |
| 2008/0196893 | A1 * | 8/2008 | Berger | C09K 8/602 | 166/270.1 |
| 2011/0259585 | A1 | 10/2011 | Banerjee et al. | | |
| 2012/0312534 | A1 | 12/2012 | Nasr et al. | | |
| 2013/0020085 | A1 | 1/2013 | Pone et al. | | |

* cited by examiner

POLYOL FOR IMPROVING SWEEP EFFICIENCY IN OIL RESERVOIRS

PRIORITY CLAIM

This application is a non-provisional application which claims benefit under 35 USC § 119(e) to U.S. Provisional Application Ser. No. 61/820,955 filed May 8, 2013, entitled "POLYOL FOR IMPROVING SWEEP EFFICIENCY IN OIL RESERVOIRS," which is incorporated herein in its entirety.

FEDERALLY SPONSORED RESEARCH STATEMENT

Not applicable.

REFERENCE TO MICROFICHE APPENDIX

Not applicable.

FIELD OF THE INVENTION

The invention relates generally to enhanced oil recovery techniques, and, in particular, to an improved chemical flood technique utilizing a viscosified displacing phase. Glycerol and its derivatives are used as a more cost effective and environmentally friendly viscosifying agent for improved mobility and sweep efficiency during oil recovery.

BACKGROUND OF THE INVENTION

Crude oil is classified as light, medium or heavy, according to its measured API gravity, although not all parties use the same grading, and the United States Geological Survey uses slightly different definitions. Light crude oil is defined as having an API gravity higher than 31.1° API (less than 870 kg/m3). Medium oil is defined as having an API gravity between 22.3° API and 31.1° API (870 to 920 kg/m3). Heavy crude oil is defined as having an API gravity below 22.3° API (920 to 1000 kg/m3). Extra heavy oil is defined with API gravity below 10.0° API (greater than 1000 kg/m3). Bitumen derived from the oil sands deposits in the Alberta, Canada area has an API gravity of around 8° API.

Conventional (light and medium) oil reserves are preferred sources of oil because they provide a high ratio of extracted energy over energy used in the extraction and refining processes it undergoes. Unfortunately, due to the physics of fluid flow, not all conventional oil can be produced. Only a fraction of the original oil in a reservoir can be produced by primary recovery methods, i.e. methods that rely on the energy in the formation. Primary methods usually result in recovery of only 5-15% of the original oil in place (OOIP).

As conventional oil sources become scarce or economically non-viable, unconventional (heavy and extra-heavy) oil sources are being explored as a potential supply of oil. World reserves for unconventional oil are estimated to be over 3 times greater than those of conventional oil. However, producing unconventional oil can be quite challenging because the heavy and extra heavy oils and bitumen can be very viscous and even solid at room temperature, making them impossible to move towards a producer well without using any methods to reduce the in-situ oil viscosity. These properties make it difficult to simply pump unconventional oil out of the ground. Thus, its production is a less efficient process than conventional oil.

For both conventional and unconventional reservoirs, secondary recovery methods utilizing waterflooding tends to be less efficient when the water sometimes bypasses the oil. Thus, enhanced oil recovery (EOR) techniques are often employed to increase the amount of hydrocarbons extracted. During an EOR process, compounds not naturally found in the reservoir are injected into the reservoir to assist in oil recovery by altering the original properties of the oil/brine/rock. Simply stated, EOR techniques overcome the physical forces holding the hydrocarbons underground. There are many types of EOR techniques that are categorized by the compound being injected such as gases, chemicals, microbials and steam.

Choosing an EOR technique often depends on many factors such as the type of reservoir (rock), oil viscosity, reservoir permeability and wettability to name a few. Using an EOR technique, sometimes also called tertiary recovery methods, 30-60% or more of the original oil in place can be extracted. Additionally, EOR techniques can be applied in both conventional and unconventional oil reserves. A summary of various EOR techniques is presented in Table 1.

TABLE 1

| Enhanced Oil Recovery (EOR) Techniques | |
|---|---|
| CSS | Cyclic Steam Stimulation or "huff and puff." Steam is injected into a well for a period of weeks to months. The well is allowed to sit for days to weeks to allow heat to soak into the formation, and, later, the hot oil is pumped out of the well for weeks or months. Once the production rate falls off, the well is put through another cycle of steam injection, soak and production. This process is repeated until the cost of injecting steam becomes higher than the money made from producing oil. Recovery factors are around 20 to 25%, but the cost to inject steam is high. |
| SAGD | Steam Assisted Gravity Drainage uses at least two horizontal wells—one at the bottom of the formation and another about 5 meters above it. Steam is injected into the upper well, the heat reduces the viscosity of the heavy oil, which allows it to drain by gravity into the lower well, where it is pumped to the surface. SAGD is cheaper than CSS, allows very high oil production rates, and recovers over 60% of the oil in place within the drainage area. |
| VAPEX | Vapor Extraction Process is similar to SAGD, but instead of steam, hydrocarbon solvents are injected into an upper well to dilute heavy oil and enables the diluted heavy oil to flow into a lower well. |
| ISC | In Situ Combustion involves burning of a small amount of the oil in situ, the heat thereby mobilizing the heavy oil. |
| THAI | Toe to Heel Air Injection is an ISC method that combines a vertical air injection well with a horizontal production well. The process ignites oil in the reservoir and creates a vertical wall of fire moving from the "toe" of the horizontal well toward the "heel", which burns the heavier oil components and upgrades some of the heavy bitumen into lighter oil right in the formation. |

TABLE 1-continued

| Enhanced Oil Recovery (EOR) Techniques | |
|---|---|
| COGD | Combustion Overhead Gravity Drainage is another ISC method that employs a number of vertical air injection wells above a horizontal production well located at the base of the bitumen pay zone. An initial Steam Cycle similar to CSS is used to prepare the bitumen for ignition and mobility. Following that cycle, air is injected into the vertical wells, igniting the upper bitumen and mobilizing (through heating) the lower bitumen to flow into the production well. It is expected that COGD will result in water savings of 80% compared to SAGD. |
| EM | A variety of electromagnetic methods of heating oil in situ are also being developed. |
| GAS INJECTION | A variety of gas injection methods are also used or being developed, including the use of cryogenic gases. |
| CHEMICAL FLOOD | A variety of displacing fluids or dilute solutions for injection is being used or being developed. |
| COMBO | Any of the above methods can be used in combination. |
| ES-SAGD | Expanding solvent SAGD |
| SLAG | Solvent Liquid Alternating Gas |
| SAP | Solvent aided process |

Many EOR techniques, particularly the thermal methods, improve oil recovery by reducing the viscosity of the oil. Other methods, such as the displacement methods, improve oil recovery by injecting displacing phases to improve oil mobility.

For displacement EOR techniques, the injected fluids and injection processes supplement the natural energy present in the reservoir to displace oil to a producing well. In addition, the injected fluids interact with the reservoir rock/oil/brine system to create conditions favorable for oil recovery.

Water was initially used for displacing oil. However, its 'thin' viscosity and tendency to move past the oil through cracks and regions of high permeability has prevented waterfloods from being completely effective in secondary oil recovery. As such, chemical floods have become a popular displacing technique.

The general procedure of a chemical flooding, illustrated in FIG. 1 as a polymer flood, includes a preflush with low-salinity water, a chemical solution, a mobility buffer to protect the chemical solution, and, finally, a driving fluid (usually water), which displaces the chemicals and the resulting oil bank to production wells. The preflush and the mobility buffer are optional fluids.

The various chemicals, usually in dilute solutions, are injected in the well to displace the oil and/or to alter the properties of the oil reservoir. For instance, micellar, alkaline and soap-like substances are used to reduce surface tension between oil and water in the reservoir, thereby increasing the displacement of oil. U.S. Pat. No. 3,468,377 discloses the use of petroleum sulfonates in water flood operations, and U.S. Pat. No. 3,553,130 discloses the use of ethylene oxide adducts of alkyl phenols for the same purpose.

Field operations employing surface-active agents or surfactants in the injected floodwater have not always been entirely satisfactory. In order to maintain a sufficient concentration of the surfactant at the oil/water interface, it has been necessary to use a very large concentration of surfactant in the floodwater. Since flood operations typically involve enormous quantities of injected fluid, it requires the use of surfactants in sufficiently high amounts, which imposes a severe adverse economic burden on the process.

A favorable mobility ratio yields higher oil recovery and therefore, one of the main goals in these chemical EOR methods is choosing a chemical that yields favorable mobility ratios. Two main approaches that could be taken to obtain favorable mobility ratios are either to reduce the viscosity of the oil (displaced phase) or increase the viscosity of the displacing phase such as water/brine.

Polymers such as polyacrylamide or polysaccharide are employed to improve sweep efficiency by making the displacing phase more viscous. Since U.S. Pat. No. 2,431,500 disclosed a method of using polymers in chemical floods, much research in the oil and gas industry has focused on this work.

Both natural occurring polymers (see e.g. U.S. Pat. No. 2,771,138) and synthetic polymers and copolymers (see e.g. U.S. Pat. Nos. 2,842,492, 3,002,960, 2,775,557, 3,841,401) have been used to improve sweep efficiency. For example, U.S. Pat. No. 3,039,529 and U.S. Pat. No. 3,282,337 teach the use of aqueous polyacrylamide solutions to increase the viscosity of the injected fluid. U.S. Pat. No. 3,581,824 teaches the use of polysaccharides for the same purpose.

However, chemicals used for floods, especially polymers, have many drawbacks. These chemicals are often expensive and may not be environmentally friendly. Furthermore, differences in reservoir porosity and formation have led to unpredictability in the chemicals' effectiveness.

Additionally, polymers often require high concentrations for efficient heavy oil recovery. It is well known in the oil and gas community that commonly used viscosity-increasing polymers adsorb onto the formation rock. This adsorption loss tends to decrease the efficiency of the material and increase the cost of any such program. Furthermore, polymer floods are often not very successful in high temperature reservoirs.

What is needed in the art is a cheaper and more efficient method for increasing the mobility of oil. Preferably, this method can be used for heavy oil and bitumen, too. Ideally, this method would be more environmentally friendly, not adversely affect the reservoir formation, and reduce the residual oil saturation.

SUMMARY OF THE INVENTION

The present invention describes a novel method of improving the mobility and sweep efficiency of oil to increase oil recovery. In particular, the viscosity of the displacing phase is increased to improve the mobility and sweep efficiency of oil, heavy oil or bitumen, thus leading to improved oil recovery. The novel feature of the present method is the use of a polyol to increase the viscosity of a displacing phase. Alternatively, the viscous polyol can also be used alone as the viscous displacing phase.

Previous EOR displacing methods have focused on synthetic or natural polymer additives to increase viscosity of the mobile phase. However, these methods are often costly because the polymers are expensive to manufacture and a high concentration is needed. Additionally, many of the polymers currently used for flooding oil reservoirs are unable to significantly increase the viscosity of the displacing phase.

In the present invention, glycerol and its derivatives are the preferred polyols for viscosifying the displacing phase. Glycerol and its derivatives are a much cheaper option than the synthetic polymers or other chemicals normally used in floods and they increase the viscosity of the displacing phase to a much greater extent. Additionally, glycerol and its derivatives are much less toxic and more environmentally friendly than other chemicals commonly used.

Glycerol is particularly attractive because it is a byproduct of biodiesel production, is quite inexpensive, and is readily available. Biodiesel production generates about 10% (w/w) glycerol as the main byproduct. It is projected that the world biodiesel market would reach 37 billion gallons by 2016, which implies that approximately 4 billion gallons of crude glycerol will be produced annually. This surplus of crude glycerol from biodiesel production impacts the refined glycerol market. For example, in 2007, refined glycerol's price was painfully low, approximately $0.30 per pound (compared to $0.70 before the expansion of biodiesel production) in the United States. Accordingly, the price of crude glycerol decreased from about $0.25 per pound to $0.05 per pound. Therefore, development of sustainable processes for utilizing this organic raw material is imperative.

Another advantage of using glycerol and its derivatives is their complete solubility in water, but not oil. As such, fewer emulsions are present in the produced fluid, thus reducing the costs of breaking the emulsions post-production.

Glycerol and its derivatives also do not affect the wettability of the reservoirs. Wettability affects the relative permeability of the reservoir because it is a major factor in the control of the location, flow, and distribution of fluids in the porous formation. By not affecting the wettability, the impact of using glycerol purely as a viscosifying agent could be calculated and quantified easily.

Another benefit of using glycerol and its derivatives is the wide range of viscosities, allowing higher viscocity glycerol derivatives to be used for higher viscosity oil. The viscosity range for heavy oil is 100-10,000 cP (10-22° API gravity) and extra-heavy oil or bitumen is 10,000-100,000+cP (less than 10° API gravity). Mobility ratios (M) equal to or lesser than 1 are considered to be favorable to obtain good sweep efficiency from a reservoir. Table 2 displays the viscosities of various displacing phases at room temperature.

TABLE 2

Viscosity of Displacing Phases

| Chemical | Viscosity (cP) |
|---|---|
| Water | ~1.0 |
| Brine *Can vary with salinity | ~1.554 >1.0 |
| Glycerol | 1500 |
| Diglycerol | 12,000-13,000 |
| Polyglycerol | 25,000 |

For reservoirs containing oil with viscosities closer to 10,000 cP, polyglycerol would be a better polyol than glycerol because the mobility ratio would be less than 1. For reservoirs with conventional oil, glycerol may be viscous enough to improve recoveries. Thus, the choice of polyol or combination of multiple polyols can be tailored for the oil reservoir makeup.

In addition to being mixed with water, a viscous polyol can be used by itself to improve sweep efficiency. This would be helpful for the recovery of extra heavy oil or bitumen because a 100% viscous polyol would have a more favorable mobility ratio with respect to the oil than with a viscous polyol/water solution.

In one embodiment, glycerol, glycerol derivatives, polyglycerols or a mixture thereof is used as the viscous displacing phase in a chemical flood. Examples of glycerol derivatives include esters, acetals, ethers and amines. Polyglycerols including diglycerol, polyglycerol-3 and polyglycerol-4 are also capable of increasing the viscosity of the displacing phase. Additionally, the above-mentioned polyols can be mixed to increase the range of oil viscosities that are recoverable.

In another embodiment, glycerol, glycerol derivatives, polyglycerols, polyglycerol derivatives, or mixtures thereof are used to increase the viscosity of a more common displacing phase used in a chemical flood.

Brine is naturally produced during the oil recovery process and is normally re-injected during oil recovery operations to decrease the cost associated with disposal of such water and to maintain oil reservoir pressures. Other types of water can also be used as the displacing phase. In one embodiment, seawater is used. In yet another embodiment, fresh water is the displacing phase.

In the present invention, other chemicals such as polymers can be used to further increase the viscosity of the polyol/displacing phase solution if economically reasonable.

The viscous displacing phase can be used as a secondary or tertiary recovery strategy for heavy oil or bitumen. For secondary recovery, the viscous displacing phase is used to increase oil recovery before another EOR method. In one embodiment, the polyol-viscosified displacing phase is used to directly flood a heavy oil reservoir. Alternatively, a slug of the chosen polyol could be injected directly into the reservoir before a hot or cold water flood. In yet another embodiment, only the polyol is injected and used to flood the reservoir.

Another embodiment provides for the use of the polyol/displacing phase or polyol itself as an alternating slug with a gas such as $CO_2$ or hydrocarbons. In this embodiment, the gas reduces the oil viscosity by saturating the oil. This will make the mobility ratio of the oil and displacing phase more favorable.

For tertiary recovery, the viscous displacement can be used after other enhanced oil recovery techniques that decrease the viscosity of the heavy oil. These can include thermal, chemical, or gas flood EOR methods.

Preferred methods include typical polymer sweep methods, as shown in FIG. 1, where the polyol is used in the place of more expensive chemicals to sweep the reservoir, in this example using five spot vertical wells. The polyol sweep can be initiated using existing vertical or horizontal injection wells, even in a SAGD operation (FIG. 2), or in the alternative, an additional well near the top of the steam chamber can be used, as shown in FIG. 3. Such may provide a more efficient sweep in gravity drainage based methods.

In one embodiment, crude oil diluents are injected into the well to decrease the heavy oil viscosity before the polyol-viscosified displacing phase is injected. Crude oil diluents, such as n-alkanes (n-pentane, n-hexane, n-heptane, etc), kerosene, acetophenone, cumene, xylene, toluene, benzene, cyclohexanone, N-methylpyrrolidinone, alpha-methlynapthalene (AMN), natural gas, $CO_2$, and mixtures thereof, could be used after the production phase to help heavy oil and bitumen flow. Additionally, derivatives of the above chemicals with similar characteristics can be used to dilute the crude oil to enable the oil to flow. Examples of using these compounds to dilute heavy oil can be found in U.S. Pat. No. 4,470,899 and is incorporated herein.

Other chemicals used to decrease the viscosity of the oil, such as the solvents used in VAPEX and other solvent aided processes (SAP), can be injected before the present invention, or alternating therewith.

The method can be combined with EOR techniques. In another embodiment, a thermal method is used to decrease the viscosity of the oil before the viscous displacing phase is injected. This includes methods such as steam floods, cyclic steam floods, SAGD, and variants thereof.

In another embodiment, a slug of the chosen polyol is injected following a hot-water injection. Here, the hot water decreases the viscosity of the oil, thus leading to a more favorable mobility ratio between the oil and water.

The phrase "API gravity" is a measure of how heavy or light a petroleum liquid is. In general, if the API gravity is greater than 10, it is lighter than water (lower density); less than 10, it is heavier.

The term "displacing phase" is used to denote a fluid or gas being injected into a reservoir to increase oil production by mobilizing the oil towards the production well. Both the sweep and displacement efficiency are used to describe the success of the displacing phase. The sweep efficiency of the reservoir depends on the mobility ratio between the displacing phase and the oil. In contrast, the displacement efficiency is dependent on the mobility ratio, the wettability of the rock, and the pore geometry.

The terms "oil" or "crude oil" as used herein broadly refers to liquid or solid hydrocarbons found in subsurface reservoirs. The terms "heavy oil," "extra-heavy oil" or "bitumen" are also used to refer specifically the viscous liquid or solid forms of hydrocarbons found in subsurface reservoirs.

The term "polyol" as used herein refers to compounds containing more than one hydroxyl group. In the present disclosure, these compounds are preferably glycerol, glycerol derivatives, and polyglycols.

When we refer to "100% glycerol" herein, we do not mean to imply anhydrous glycerol. Unless special care is taken, 100% glycerol will always contain some amounts of water. However, no additional water is added to 100% glycerol and it is used as is.

The term "water" as used herein refers to all sources of water including produced water, brine, seawater or freshwater. Essentially, any type of water that does not contain high amounts of solid particulates (other than proppants) that can be injected into the reservoir formation can be used. Water sources with solid particulates can be used after undergoing a filtration or solid separation process.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as buffers, chelators, and the like.

The following abbreviations (Table 3) are used herein:

TABLE 3

| Abbreviations | |
|---|---|
| AMN | alpha-methlynapthalene |
| API | American Petroleum Institute |
| COGD | Combustion Overhead Gravity Drainage |
| cP | centipoise |
| CSS | Cyclic Steam Stimulation |
| EM | Electromagnetic |
| EOR | Enhanced Oil Recovery |
| ES-SAGD | Expanding solvent SAGD |
| ISC | In Situ Combustion |
| M | Mobility ratio |
| OOIP | Original Oil in Place |
| PV | Pore volume |
| SAGD | Steam Assisted Gravity Drainage |
| SAP | Solvent aided process |
| SLAG | Solvent Liquid Alternating Gas |
| THAI | Toe to Heel Air Injection |
| VAPEX | Vapor Extraction Process |

DETAILED DESCRIPTION

Figure 1:
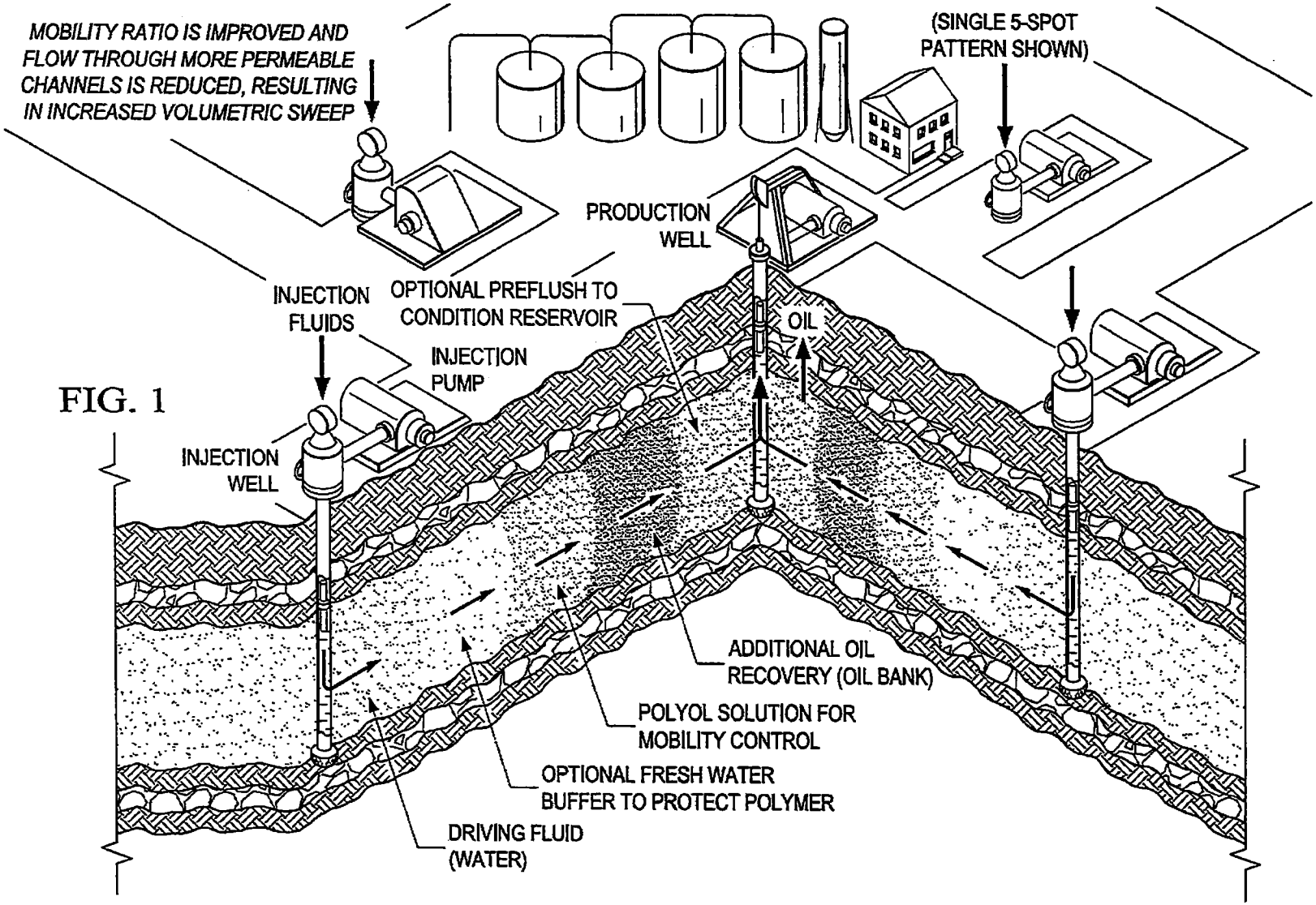
FIG. 1. Schematic of a polyol-based chemical flood using a five-spot aerial pattern.
Figure 2:
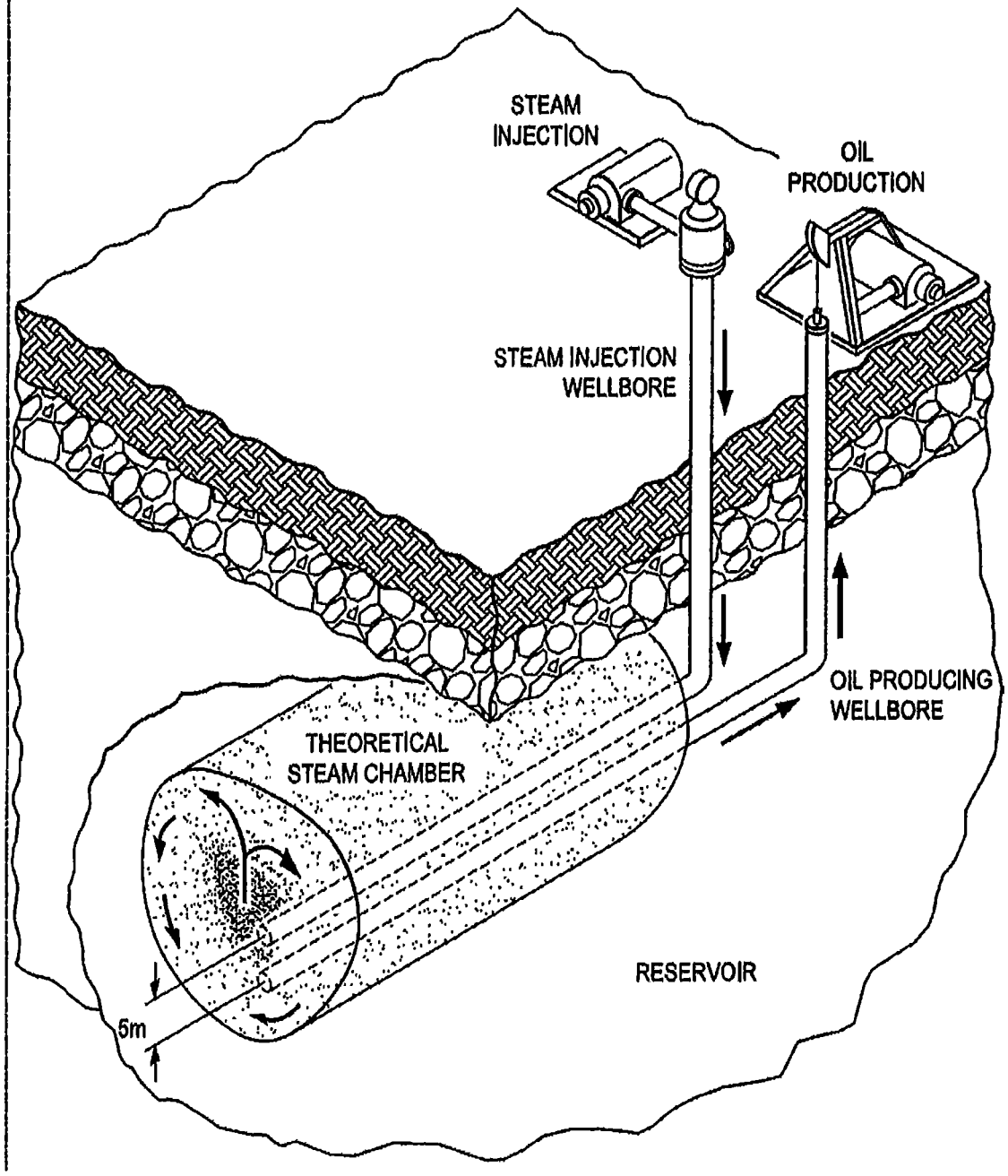
FIG. 2 Showing a SAGD technique that can be combined with a polyol sweep, wherein gravity drainage can be improved by sweeping the reservoir with a polyol as described with the methods of the invention.
Figure 3:
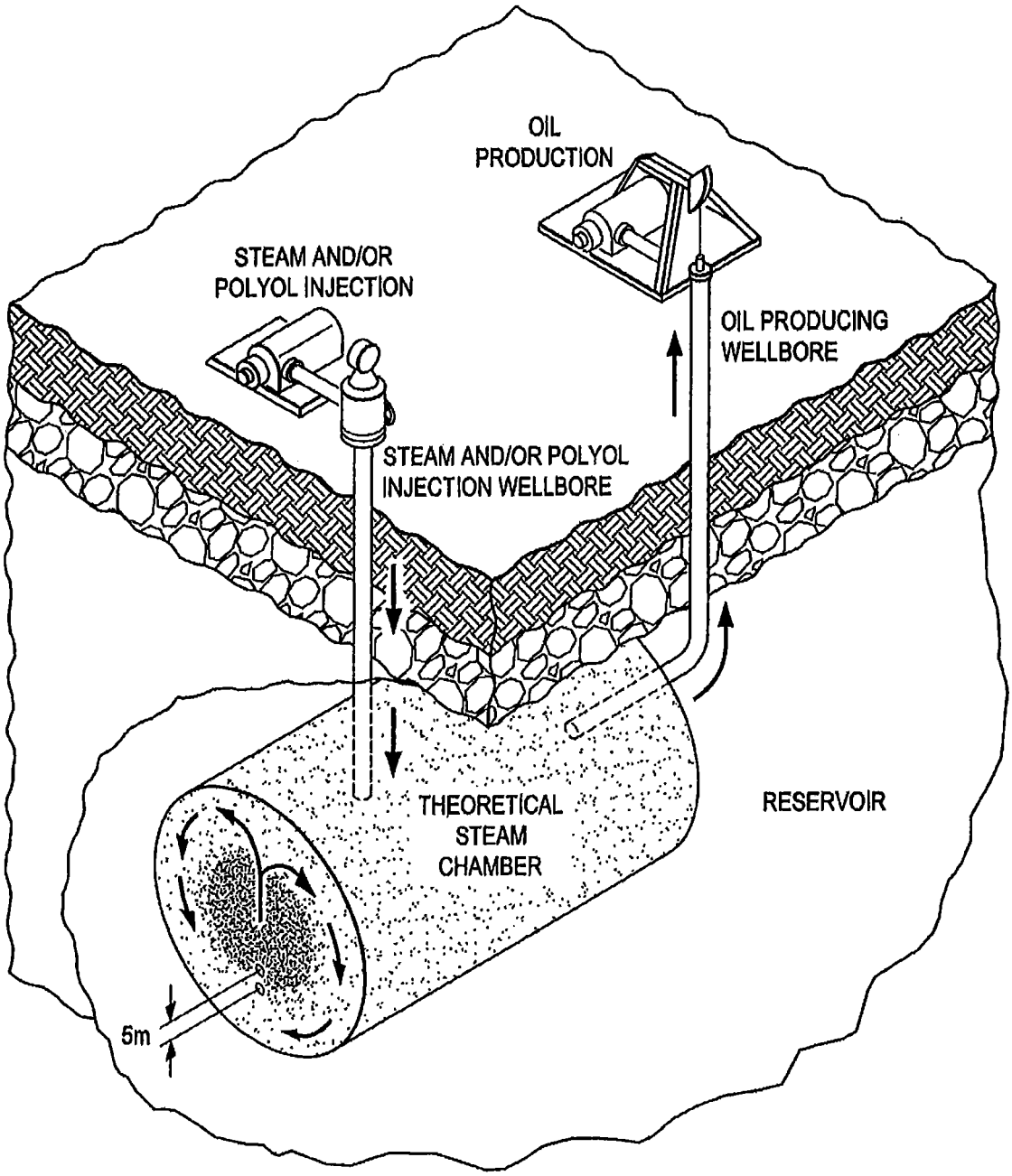
FIG. 3. Reference SAGD method.

The present invention describes a novel method of enhancing heavy oil recovery. In particular, the viscosity of the displacing phased used to flooding the reservoir is increased through the use of a polyol. Polyols, especially glycerol based polyols, increase the viscosity by a greater amount than other compounds commonly used and are much cheaper.

A method of improving oil recovery is provided, comprising injecting an aqueous solution comprising a polyol into at least one injection well in a reservoir, said injection well being in fluid communication with at least one producing well; displacing the oil in said reservoir using said aqueous solution; and producing said oil and aqueous solution in said at least one producing well.

Preferably, the aqueous solution contains water and a polyol, such as 10-100% polyol and 0-90% water. The water can be produced brine, seawater, fresh water, or mixtures thereof, but any convenient source of water can be used.

Preferable polyols are glycerol, diglycerol, polyglycerol-3, polyglycerol-4, or derivatives or mixtures thereof, and especially glycerol based polyols. The aqueous polyol can also contain other conventional additives, or other inexpensive polymers, such as a polyacrylamide or polysaccharide polymer.

A process for displacing oil within an oil bearing formation penetrated by at least one injection well in fluid communication with at least one producing well is also provided. The method comprises injecting from about up to 1.0 pore volume of aqueous fluid into said formation through said at least one injection well to move said oil to at least one production well, in said volume of aqueous fluid containing a polyol.

Another embodiment provides a method for recovering oil from a subterranean reservoir, said reservoir being penetrated by at least one injection well and by at least one production well, both wells being in fluid communication with at least a portion of the subterranean reservoir, comprising: injecting into the reservoir via said injection well, an aqueous polyol containing fluid, said polyol comprising glycerol, diglycerol, polyglycerol-3, polyglycerol-4 or a mixture thereof; and recovering oil displaced by said aqueous polyol containing fluid.

Another embodiment provides a method of improving oil recovery from a reservoir, said reservoir being penetrated by at least one injection well and by at least one production well, both wells being in fluid communication with at least a portion of the subterranean reservoir, comprising: performing a thermal enhanced oil recovery technique on said reservoir; injecting into said reservoir, via said injection well, an aqueous polyol containing fluid, said polyol comprising glycerol, diglycerol, polyglycerol-3, polyglycerol-4 or a mixture thereof; and recovering oil displaced by said aqueous polyol containing fluid.

The thermal enhanced oil recovery technique, can be any known or to be developed, and includes SAGD, CSS, steam flood, VAPEX, ES-SAGD/SAP, SLAG or other thermal recovery methods.

In yet another embodiment a method, of improving bitumen recovery from a reservoir is provided where the reservoir is penetrated by at least one injection well and by at least one production well, both wells being in fluid communication with at least a portion of the subterranean reservoir, comprising: a) inject crude oil diluents via said injection well, to decrease the viscosity of said bitumen; b) injecting into said reservoir via said injection well, an aqueous polyol containing fluid, said polyol comprising glycerol, diglycerol, polyglycerol-3, polyglycerol-4 or some mixture thereof; and c) recovering said bitumen displaced by said aqueous polyol containing fluid.

The crude oil diluents can be any convenient and inexpensive diluent, including n-alkanes, kerosene, acetophenone, cumene, xylene, toluene, benzene, cyclohexanone, N-methylpyrrolidinone, alpha-methlynapthalene (AMN), and mixtures of thereof. Natural gas and $CO_2$ can also be used.

In yet another embodiment, is provided a method of improving sweep efficiency of a reservoir, wherein a sweep fluid is injected into a reservoir to drive oil towards a production well, the improvement comprising using aqueous glycerol, diglycerol, or polyglycerol, or derivatives and mixtures thereof as the sweep fluid.

All of the references cited herein are expressly incorporated by reference for all purposes. The discussion of any reference is not an admission that it is prior art to the present invention, especially any reference that may have a publication data after the priority date of this application. Incorporated references are listed again here for convenience:

1. U.S. Pat. No. 2,431,500, Penick, "Alkylation Process," Socony Vacuum Oil Co., (1947).
2. U.S. Pat. No. 2,771,138, Beeson, "Waterflooding Method of Secondary Recovery," Exxon Res. Eng. Co. (1956).
3. U.S. Pat. No. 2,775,557, Morgan, "Drilling Muds Containing Acidacrylamide Copolymer Salts," American Cyanamid Co. (1956).
4. U.S. Pat. No. 2,842,492, Von Engelhardt, et al., "Process for Increasing the Yield of Oil upon the Flooding with Water of Oil Deposits," Roehm & Haas GMBH. (1958).
5. U.S. Pat. No. 3,002,960, Kolodny, "Polyacrylamide Preparation," American Cyanamid Co. (1961).
6. U.S. Pat. No. 3,039,529, McKennon, "Secondary Recovery of Petroleum," Dow Chemical Co. (1962).
7. U.S. Pat. No. 3,282,337, Pye, "Water Flooding Process for the Recovery of Petroleum," Dow Chemical Co. (1966).
8. U.S. Pat. No. 3,468,377, Dunlap & Foster, "Waterflooding Employing Surfactant Solution," Mobil Oil Corp. (1969)
9. U.S. Pat. No. 3,553,130, Stratton, "Oil Recovery," Phillips Petroleum Co. (1971).
10. U.S. Pat. No. 3,581,824, Hurd, "Oil Recovery Process Using an Ionic Polysaccharide Thickening Agent," Mobil Oil Corp. (1971).
11. U.S. Pat. No. 3,841,401, Restaino, "Process for Recovering Hydrocarbon Using Polymer Obtained by Radiation Polymerization," ICI America Inc. (1974).
12. U.S. Pat. No. 4,470,899, Miller & Hupka, "Bitumen Recovery from Tar Sands," Univ. Utah (1984).

What is claimed is:

1. A method of improving oil recovery, comprising:
a) measuring the viscosity of oil in a reservoir;
b) selecting a fluid consisting essentially of a polyol and yielding a mobility ratio (M) of less than;
c) injecting said fluid into at least one injection well in a reservoir, said injection well being in fluid communication with at least one producing well;
d) displacing the oil in said reservoir using said fluid; and
e) producing said oil and said fluid in said at least one producing well.

2. The method of claim 1, wherein said polyol consists of glycerol, polyglycerol, or a derivative thereof.

3. The method of claim 2, wherein said polyol is chosen from the following group:
glycerol, diglycerol, polyglycerol-3, polyglycerol-4, or derivatives or mixtures thereof.

4. The method of claim 1, wherein said polyol is up to a 100% wt glycerol, diglycerol, polyglycerol-3, or polyglycerol-4.

5. A process for displacing oil within an oil bearing formation penetrated by at least one injection well in fluid communication with at least one producing well, comprising measuring the viscosity of oil in a reservoir, selecting a fluid consisting essentially of a polyol and yielding a mobility ratio (M) of less than 1, and injecting from about up to 1.0 pore volume of said fluid into said formation through said at least one injection well to move said oil to at least one production well.

6. The process of claim 5, wherein said polyol is chosen from the following group:
glycerol, diglycerol, polyglycerol-3, polyglycerol-4, derivatives or mixtures thereof.

7. A method for recovering oil from a subterranean reservoir, said reservoir being penetrated by at least one injection well and by at least one production well, both wells being in fluid communication with at least a portion of the subterranean reservoir, comprising:
a) measuring the viscosity of oil in a reservoir;
b) selecting a fluid consisting essentially of a polyol and yielding a mobility ratio (M) of less than 1, said polyol selected from glycerol, diglycerol, polyglycerol-3, polyglycerol-4, derivatives or mixtures thereof;

c) injecting said fluid into the reservoir via said injection well; and d) recovering oil displaced by said fluid.

8. A method of improving oil recovery from a reservoir, said reservoir being penetrated by at least one injection well and by at least one production well, both wells being in fluid communication with each other and at least a portion of the subterranean reservoir, comprising:

a) measuring the viscosity of oil in a reservoir;

b) performing a thermal enhanced oil recovery technique on said reservoir;

c) measuring the viscosity of oil in a reservoir after said thermal enhanced oil recovery technique;

d) selecting a fluid consisting essentially of a polyol and yielding a mobility ratio (M) of less than 1, said polyol selected from glycerol, diglycerol, polyglycerol-3, polyglycerol-4, or derivatives thereof;

e) injecting said fluid into said reservoir, via said injection well; and f) recovering oil displaced by said fluid.

9. The method of claim 8, wherein said thermal enhanced oil recovery technique is SAGD, CSS, steam flood, VAPEX, ES-SAGD/SAP, SLAG or a combination thereof.

10. A method of improving sweep efficiency of a reservoir, wherein a sweep fluid is injected into a reservoir to drive oil towards a production well, the improvement comprising measuring the viscosity of oil in a reservoir, selecting a polyol that yields a mobility ratio (M) of less than 1 in said reservoir, said polyol consisting essentially of glycerol, diglycerol, polyglycerol or mixtures thereof as the sweep fluid, wherein said sweep fluid consists essentially of said polyol.

* * * * *